US009421665B2

(12) United States Patent
Schuh et al.

(10) Patent No.: US 9,421,665 B2
(45) Date of Patent: Aug. 23, 2016

(54) PRESSURE-ADJUSTING LAPPING ELEMENT

(71) Applicant: Veeco Instruments, Inc., Plainview, NY (US)

(72) Inventors: Gregory W. Schuh, Bay Shore, NY (US); Laurent Heughebaert, Santa Paula, CA (US)

(73) Assignee: VEECO INSTRUMENTS, INC., Plainview, NY (US)

( * ) Notice: Subject to any disclaimer, the term of this patent is extended or adjusted under 35 U.S.C. 154(b) by 87 days.

(21) Appl. No.: 14/614,641

(22) Filed: Feb. 5, 2015

(65) Prior Publication Data

US 2015/0217423 A1 Aug. 6, 2015

Related U.S. Application Data

(60) Provisional application No. 61/936,046, filed on Feb. 5, 2014.

(51) Int. Cl.
*B24B 37/30* (2012.01)
*B24B 37/10* (2012.01)

(52) U.S. Cl.
CPC ..... *B24B 37/10* (2013.01); *B24B 37/30* (2013.01)

(58) Field of Classification Search
CPC ..... B24B 37/30; B24B 37/10
USPC ..... 451/5, 8, 9, 10, 41, 11; 29/603.15, 29/603.14
See application file for complete search history.

(56) References Cited

U.S. PATENT DOCUMENTS 6,174,218 B1 1/2001 Church et al.
6,881,124 B2 * 4/2005 Takahashi ..... B24B 37/00 451/28
7,115,020 B1 10/2006 Biskeborn
2003/0199228 A1 10/2003 Kennedy et al.

FOREIGN PATENT DOCUMENTS

JP 11-216662 A 8/1999
JP 2001-179616 A 7/2001

OTHER PUBLICATIONS

US Searching Authority: International Search Report and Written Opinion, PCT/2015/014683 dated May 14, 2015, 10 pages.

* cited by examiner

*Primary Examiner* — Robert Rose
(74) *Attorney, Agent, or Firm* — HolzerIPLaw, PC

(57) ABSTRACT

A pressure-adjusting lapping element is included as a structural component of a carrier assembly in a lapping head. The lapping element includes actuator nodes that permit fine tuning of a lapping force applied through the lapping element to a work piece. An actuator assembly is directly attached to the lapping element and manipulates the individual actuator nodes. The lapping element further includes whippletree structure to permit a desired degree of flexibility in the lapping element to respond to force inputs at the actuator nodes.

20 Claims, 7 Drawing Sheets

PRESSURE-ADJUSTING LAPPING ELEMENT

CROSS-REFERENCE TO RELATED APPLICATIONS

The present application claims benefit of priority to U.S. Provisional Patent Application No. 61/936,046, entitled "Advanced Rough Lap" and filed on Feb. 5, 2014, which is specifically incorporated by reference herein for all that it discloses or teaches.

BACKGROUND

Lapping is a machining process by which two surfaces are abrasively rubbed together. Lapping generally takes one of two forms. The first form generally involves rubbing a work piece (e.g., a bar of hard disc drive heads) against a lapping plate with an abrasive (e.g., aluminum oxide, iron oxide, cerium oxide, other oxides, emery, silicon carbide, diamond) placed there between. This process forms microscopic conchoidal fractures as the abrasive rolls between the work piece and the lapping plate and removes material from both the work piece and the lapping plate. In some implementations, the abrasive is in a powder form and mixed with water or another liquid to form an abrasive slurry.

The second form of lapping generally involves rubbing the work piece against a lapping plate with an abrasive embedded in the lapping plate. For example, the lapping plate may be made up of a relatively soft material (e.g., pitch or a ductile metal) or a ceramic that holds the abrasive material and permits it to score the work piece when the work piece is rubbed against the lapping plate.

Lapping can be used to obtain a precise surface roughness and/or a very accurate surface contour (e.g., planar, convex, and concave). A lapping tool is used to provide precise dimensional control of the work piece to allow the lapping operations to achieve the desired surface roughness and/or contour on the work piece. The tool holds the work piece while it is lapped and permits precise control of the orientation of the work piece with respect to the lapping plate and fine adjustment of any load applied to the work piece during the lapping process.

Variations in surface roughness and/or contour may cause process difficulties or failures during later processing steps performed on the work piece. Further, variations in surface roughness and/or contour may cause poor performance of a resulting device. As a result, improved lapping equipment that makes tighter surface roughness and/or contour tolerances achievable and cost-effective is important to create smaller and more accurately defined devices (e.g., hard disc drive heads). Further, improved lapping equipment may achieve higher rates of material removal during the lapping process while maintaining the aforementioned surface roughness and/or contour tolerances.

SUMMARY

Implementations described and claimed herein address the foregoing problems by providing a pressure-adjusting lapping element comprising a structural region and a whippletree region. The whippletree region includes two or more actuator nodes, one or more element deflection channels oriented between the actuator nodes and the structural region permitting the whippletree region to deflect in response to an applied force at one or more of the actuator nodes, and one or more node separation channels oriented between the individual actuator nodes and permitting the actuator nodes to deflect independently in response to the applied force at the actuator nodes.

Implementations described and claimed herein address the foregoing problems by further providing a method comprising applying a lapping force to a structural region of a pressure-adjusting lapping element, applying a pressure distribution force at one or more actuator nodes of a whippletree region of the pressure-adjusting lapping element, and lapping a work piece attached to the whippletree region of the pressure-adjusting lapping element. The whippletree region includes one or more element deflection channels oriented between the actuator nodes and the structural region permitting the whippletree region to deflect in response to the pressure distribution force, and one or more node separation channels oriented between the individual actuator nodes and permitting the actuator nodes to deflect independently in response to the pressure distribution force.

Implementations described and claimed herein address the foregoing problems by still further providing a carrier assembly comprising a pressure-adjusting lapping element and an actuator assembly directly attached to the pressure-adjusting lapping element. The pressure-adjusting lapping element including two or more actuator nodes, one or more element deflection channels oriented between the actuator nodes and the structural region permitting the whippletree region to deflect in response to an applied force at one or more of the actuator nodes, and one or more node separation channels oriented between the individual actuator nodes and permitting the actuator nodes to deflect independently in response to the applied force at the actuator nodes. The actuator assembly including two or more linear actuators, each of which engages one of the actuator nodes and provides the applied force at the one or more actuator nodes.

Other implementations are also described and recited herein.

BRIEF DESCRIPTIONS OF THE DRAWINGS

Figure 7:
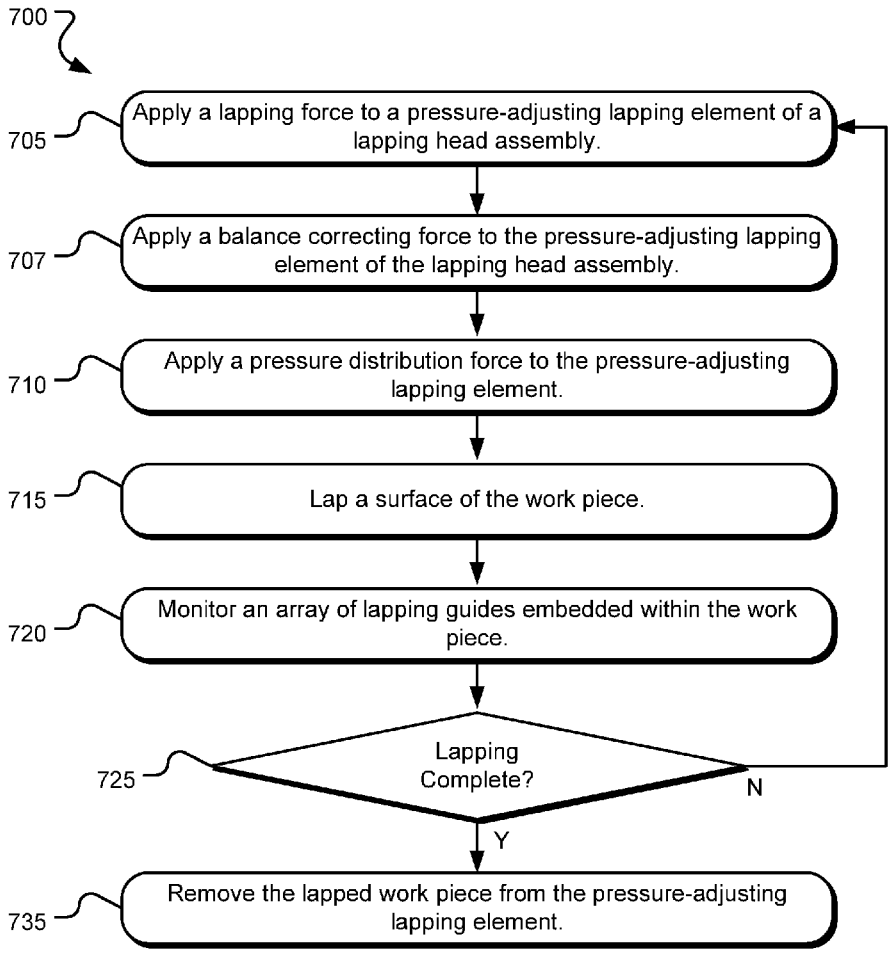

FIG. 7 illustrated example operations for lapping a work piece using an advanced lapping machine incorporating a pressure-adjusting lapping element.

DETAILED DESCRIPTIONS

Figure 1:
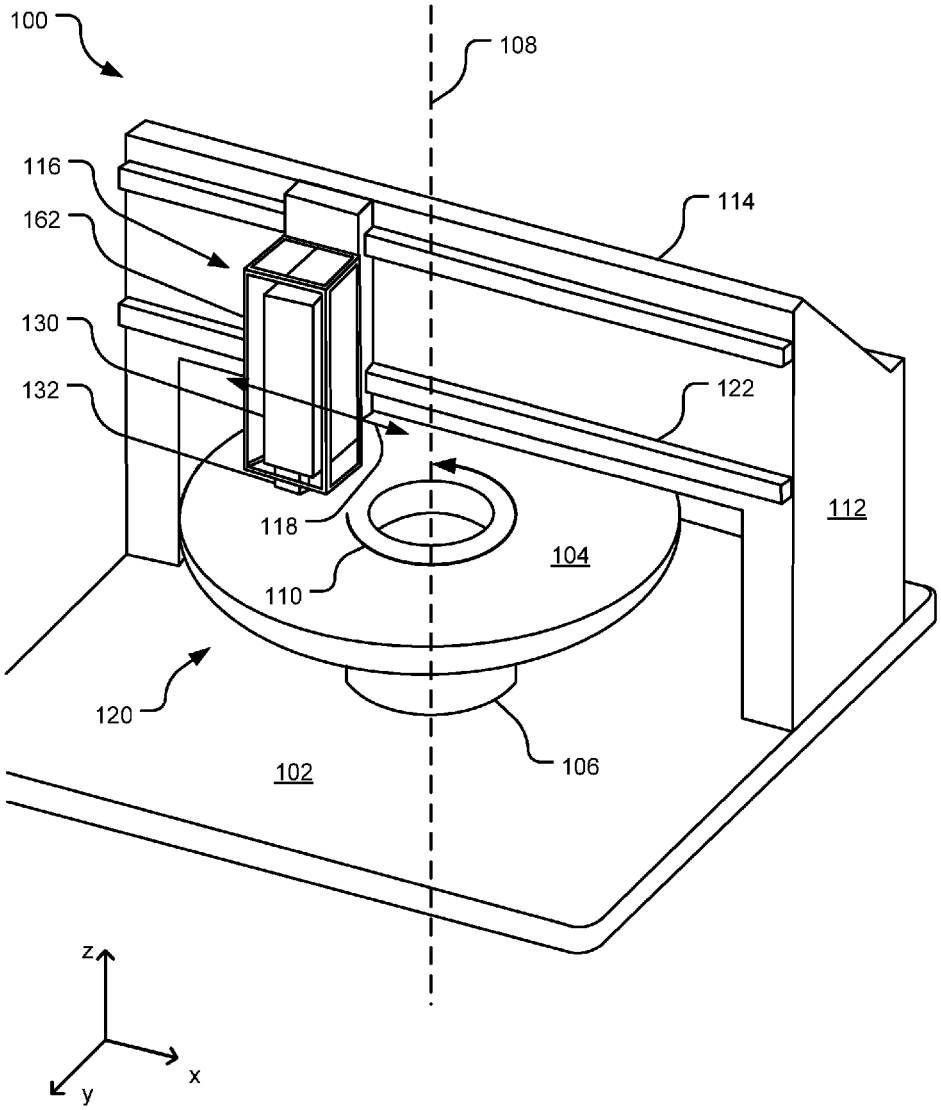
FIG. 1 is a perspective view of an example advanced lapping machine incorporating a pressure-adjusting lapping element.

FIG. 1 is a perspective view of an example advanced lapping machine 100 incorporating a pressure-adjusting lapping element 132. The lapping machine 100 includes a baseplate 102 with a lapping plate assembly 120 mounted thereon. The lapping plate assembly 120 includes a spindle 106 that rotates a lapping plate 104 about axis 108, which is oriented generally in a vertical or z-direction, as illustrated by arrow 110. Typically, rotation of the lapping plate 104 about axis 108 is motor controlled and may also be feedback controlled to achieve and maintain a desired rotational speed. A support frame 112 is also attached to the baseplate 102 and provides a fixed attachment structure for one or more lapping head rails 114, 122 upon which a lapping head assembly 116 is mounted. In other implementations, a greater or fewer number of rails may be used to secure the lapping head assembly 116.

During lapping operations, the lapping head assembly 116 oscillates back and forth along the rails 114, 122 generally in a horizontal or x-direction, as illustrated by arrow 118. The range of travel of the lapping head assembly along the rails 114, 122 lies between a location near the inside diameter of the lapping plate 104 and a location near the outside diameter of the lapping plate 104 and in a radial direction extending from the axis of rotation 108. In some implementations, the travel of the lapping head assembly 116 extends beyond the inside diameter and/or outside diameter of the lapping plate 104.

Precise movement of the lapping head assembly 116 may be accomplished using any of mechanical, electric, and/or electronic systems. For example, movement of the lapping head assembly 116 along the rails 114, 122 may be controlled by a synchronized mechanical or electro mechanical system (e.g., a servo motor controlled rack and pinion with sensors monitoring the travel of the lapping head assembly 116). The servo motor may be feedback controlled by the sensors to achieve and maintain a desired lapping head assembly 116 oscillation profile (e.g., rate and distance) across the lapping plate 104.

A carrier assembly 130 is suspended within a lapping head frame 162 of the assembly 116. The lapping head assembly 116 provides fine pitch, roll, and yaw control to the carrier assembly 130. The pressure-adjusting lapping element 132 is attached to the carrier assembly 130 and serves as a mounting structure for a work piece (e.g., a bar of hard disc drive heads or other microelectronic structure, not shown). The pressure-adjusting lapping element 132 may also form a structural component that strengthens and simplifies construction of the carrier assembly 130. The pressure-adjusting lapping element 132 may also include features (not shown) that provide enhanced bending force and deflection capabilities to achieve a desired surface contour to the work piece.

Figure 2:
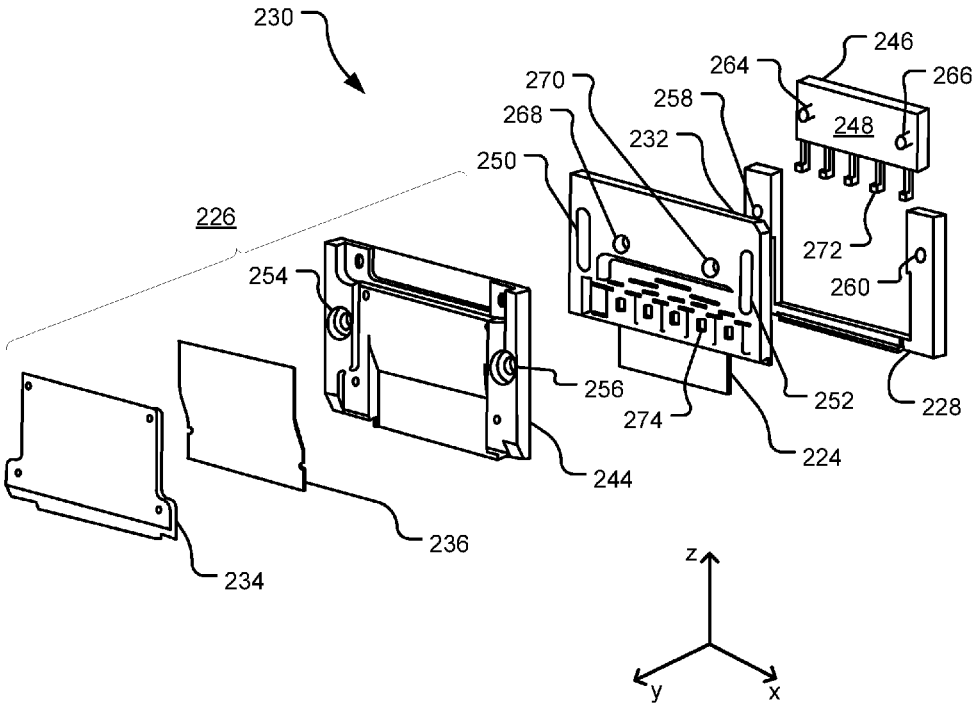
FIG. 2 is an exploded front perspective view of an example carrier assembly including a pressure-adjusting lapping element.

FIG. 2 is an exploded front perspective view of an example carrier assembly 230 including a pressure-adjusting lapping element 232. The pressure-adjusting lapping element 232 is a structural component of the carrier assembly 230 and is used to secure (e.g., glue or otherwise attach) a work piece 224 (e.g., a slider chunk). The work piece 224 may include, for example, slider material that is to be sliced into individual bars of multiple sliders. The carrier assembly 230 also includes a PCB (printed circuit board) assembly 226 that includes a base plate 244, a top plate 234, and various internal components 236 (e.g., a moisture seal, a spring, a flex connector, a PCB, etc.) are arranged as shown in FIG. 2 and clamped together to form the PCB assembly 226.

The PCB assembly 226 attaches to a work piece back support 228 with the pressure-adjusting lapping element 232 secured there between. More specifically, the pressure-adjusting lapping element 232 is secured between the PCB assembly 226 and the back support 228 and constrained from movement in the x-y plane. The pressure-adjusting lapping element 232 is able to move in the z-direction with reference to the PCB assembly 226 and the back support 228. In one implementation, fasteners (not shown) extend through holes 254, 256 in the base plate 244, slots 250, 252 in the pressure-adjusting lapping element 232, and are secured to holes 258, 260 in the back support 228, respectively. The pressure-adjusting lapping element 232 may move in the z-direction with reference to the PCB assembly 226 and the back support 228 by action of the fasteners sliding within the slots 250, 252, respectively.

The carrier assembly 230 also includes a lapping pressure actuator assembly 246, which includes male protrusions 264, 266 that engage with female receptacles 268, 270, respectively. When the carrier assembly 230 is assembled, the actuator assembly 246 is secured in the x-z plane via the protrusions 264, 266 engaging with the receptacles 268, 270. The actuator assembly 246 is secured in the y-direction by compressing the entire carrier assembly 230 together in the y-direction. For example, one or more actuators (not shown) may compress the carrier assembly 230 in the y-direction against a fixed structure (also not shown). Further, planar surface 248 of the pressure-adjusting lapping element 232 engages a similar planar surface (rear-facing, not shown) of the actuator assembly 246 to ensure secure interfacing between the pressure-adjusting lapping element 232 and the actuator assembly 246. As a result, the actuator assembly 246 is substantially constrained from movement and/or rotation is all directions with respect to the pressure-adjusting lapping element 232.

Utilizing the pressure-adjusting lapping element 232 as a structural component of the carrier assembly 230 allows the back support 228 to be u-shaped rather than solid across. The u-shaped back support 228 allows the actuator assembly 246 to be intimately and directly attached to the pressure-adjusting lapping element 232 without any other structure there between and without interference with the actuator nodes and an array of channels in the pressure-adjusting lapping element 232.

The actuator assembly 246 also includes an array of linear actuators (e.g., linear actuator 272) that may independently move in the z-direction as desired. The linear actuators each engage with a corresponding actuator node (e.g., actuator node 274) in the pressure-adjusting lapping element 232 when the carrier assembly 230 is assembled. As a result, actuation of the linear actuators in the z-direction causes a corresponding deflection of the pressure-adjusting lapping element 232, as described in further detail below.

Figure 3:
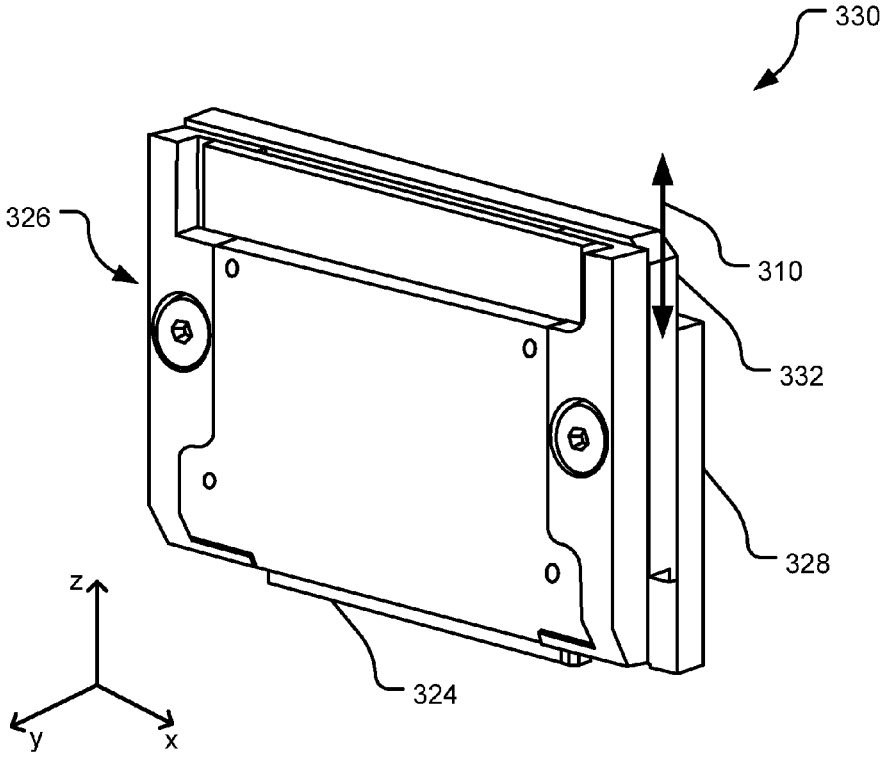
FIG. 3 is an assembled front perspective view of an example carrier assembly including a pressure-adjusting lapping element.

FIG. 3 is an assembled front perspective view of an example carrier assembly 330 including a pressure-adjusting lapping element 332. The pressure-adjusting lapping element 332 is a structural component of the carrier assembly 330 and is used to secure a work piece 324. When in operation, the PCB assembly 326 and the back support 328 remain in a fixed position, as does the pressure-adjusting lapping element 332 and the work-piece 324 with the caveat that the work-piece 324 is permitted to make small correcting movements within the assembly 330 in the z-direction, as shown by the arrow 310. As layers of the work piece 324 (e.g., wafer bars of a wafer chunk) are lapped, the carrier assembly 300 is disassembled and the next layer of the work piece 324 is advanced by sliding the pressure-adjusting lapping element 332 and its attached work-piece 324 between the PCB assembly 326 and the back support 328 to allow lapping operations to continue until the work-piece 324 is consumed. The pressure-adjusting lapping element 332 forms a part of the structure of the carrier assembly 330 and is fixedly attached to a lapping pressure actuator assembly (not shown, see e.g., lapping pressure actuator assembly 246 of FIG. 2). The pressure-adjusting lapping element 332 maintains alignment between the work piece 324 and the remainder of the carrier assembly 330.

Figure 4:
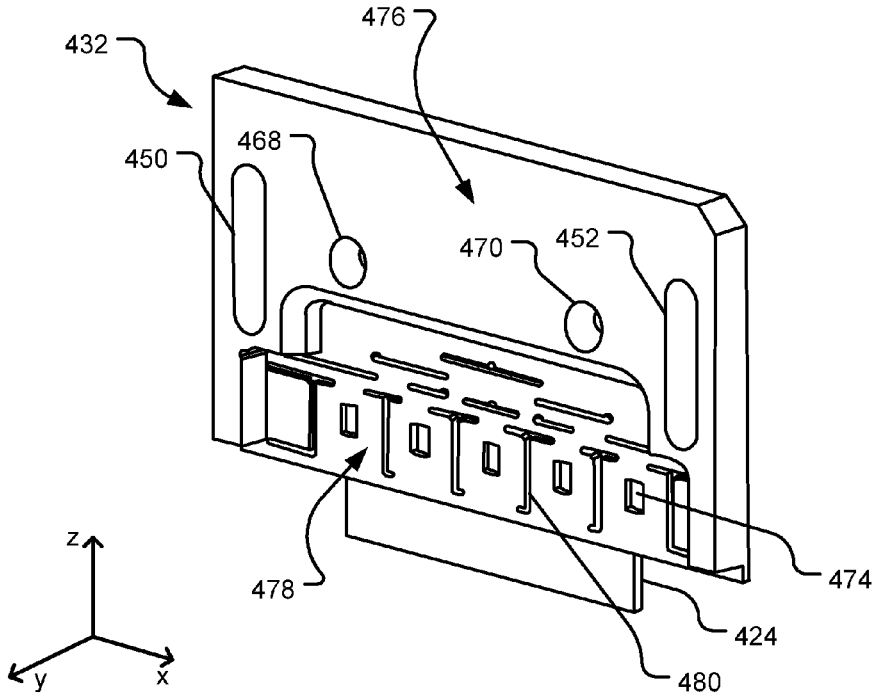
FIG. 4 is a front perspective view of an example pressure-adjusting lapping element.

FIG. 4 is a front perspective view of an example pressure-adjusting lapping element 432. The pressure-adjusting lapping element 432 includes a structural region 476 (or area of increased thickness) for attaching the pressure-adjusting lapping element 432 to other structures of a corresponding carrier assembly (not shown) and a flexible region 478 (or an area of decreased thickness) for permitting fine adjustment of pressure applied to a work piece 424 attached to the pressure-adjusting lapping element 432. In various implementations, the flexible region 478 thickness is substantially equivalent (i.e., less than 5% variance) to the work-piece/chunk thickness. Further, the various implementations, the flexible region 478 thickness is 10-30% of the structural region 476 thickness. The flexible region 478 may include a whippletree structure as depicted in FIG. 4 or any other arrangement (including one or more of material, thickness, and physical features, for example) that achieves sufficient flexibility to allow actuator nodes (e.g., actuator node 474) to manipulate the pressure-adjusting lapping element 432 as described herein.

More specifically, the structural region 476 includes a pair of slots 450, 452 through which fasteners (not shown) extend and attach the pressure-adjusting lapping element 432 to a PCB assembly (not shown) and a back support (not shown), while allowing the pressure-adjusting lapping element 432 to move in the z-direction with reference to the PCB assembly and the back support by action of the fasteners sliding within the slots slots 450, 452. The structural region 476 further includes a pair of receptacles 468, 470 that engage with corresponding protrusions (not shown) of a precision actuator assembly (not shown) and compressively secures the precision actuator assembly intimately and directly to the pressure-adjusting lapping element 432 without any other structure there between and without interference with the actuator nodes and an array of channels (e.g., channel 480) in the pressure-adjusting lapping element 432.

Figure 5:
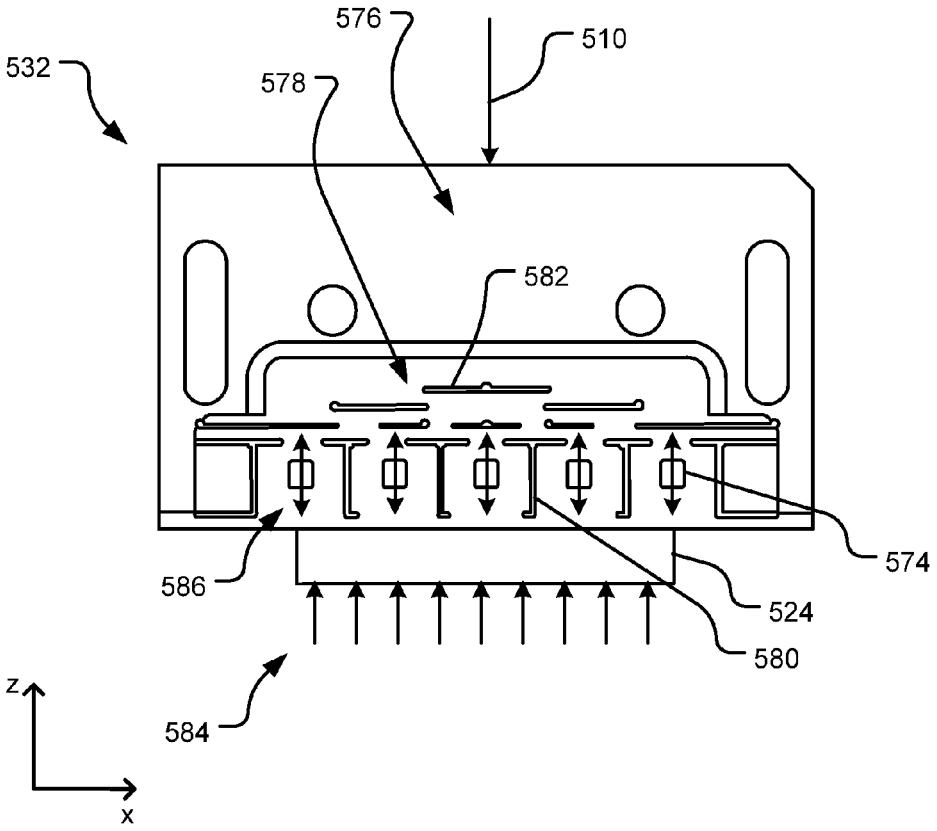
FIG. 5 is a front view of an example pressure-adjusting lapping element.

FIG. 5 is a front view of an example pressure-adjusting lapping element 532. The pressure-adjusting lapping element 532 includes a structural region 576 (or area of increased thickness) for attaching the pressure-adjusting lapping element 532 to other structures of a corresponding carrier assembly (not shown) and a flexible region 578 (or an area of decreased thickness) for permitting fine adjustment of pressure applied to a work piece 524 attached to the pressure-adjusting lapping element 532. The flexible region 578 may include a whippletree structure as depicted in FIG. 5 or any other arrangement (including one or more of material, thickness, and physical features, for example) that achieves sufficient flexibility to allow actuator nodes (e.g., actuator node 574) to manipulate the pressure-adjusting lapping element 532 as described herein.

More specifically, the flexible region 578 includes actuator nodes (e.g., actuator node 574) and an array of channels (e.g., channel 580). Corresponding linear actuators (not shown) on a precision actuator assembly (not shown) engage the actuator nodes and provide the force for fine adjustment of the flexible region 578 primarily in the z-direction. The array of channels provides the requisite flexibility of the flexible region 578 to deflect a desired amount and direction in response to the force applied to the actuator nodes via the linear actuators.

Pressure-adjusting lapping element 532 includes 5 actuator nodes, each of which corresponding to a linear actuator (not shown). The linear actuators allow the pressure-adjusting lapping element 532 to be manipulated in the z-direction in 5 separate regions separated by vertical node separation channels (e.g., channel 580) to achieve a desired lapping surface pressure profile. Further, the pressure-adjusting lapping element 532 includes an array of horizontal element deflection channels (e.g., channel 582) oriented substantially between the actuator nodes and the structural region 576 that allow the pressure-adjusting lapping element 532 to deflect under force from the actuator nodes. As a result, lapping plate pressure can be manipulated via the 5 actuator nodes to achieve a desired pressure profile on the lapping plate. Since pressure on the lapping plate is directly related to the rate of material removal, the desired pressure profile permits a desired work piece surface contour (e.g., planar, a upward-facing curve, a downward-facing curve, or any complex contour geometry) to be achieved.

In an example implementation, a 10-40N lapping force is applied to the pressure-adjusting lapping element 532 as illustrated by arrow 510. A responsive normal 10-40N force (or pressure) is exerted by a lapping plate (not shown) on the work piece 524, as illustrated by arrows 584. In order to achieve a desired pressure profile of the normal pressure exerted by the lapping plate, one or more of the actuator nodes are deflected by the linear actuators applying a +/−0-80N corrective force in the positive or negative z-direction, as illustrated by arrows 586. The resulting pressure profile influences the rate of material removal during lapping operations, which ultimately yields a desired work piece lapping surface profile. The aforementioned example is for illustration purposes, lapping forces, normal forces, and corrective forces outside the aforementioned ranges are contemplated in the presently disclosed technology.

A number, placement, orientation, and size of the channels and the actuator nodes is specifically chosen to provide desired pressure-adjusting lapping element 532 bending characteristics. Further, the pressure-adjusting lapping element 532 is configured to operate with a work piece 524 with a widely varying z-direction thickness and stiffness (e.g., a slider chunk with 44 slider bars remaining vs. a slider chunk with only 1 slider bar remaining). Still further, electronic lapping guides (not shown) embedded within the work piece 524 may monitor work piece surface contour and the pressure on the lapping plate and the surface geometry of the work piece 524 can be manipulated in real time by monitoring the electronic lapping guides to achieve the desired work piece surface contour over time. Furthermore, the number, placement, and size of the channels delineating the flexible region 578 or flexure arrangement and its actuator nodes may be precisely tailored to control pressure distribution and reaction force along a length of the work-piece 524. The channels may minimize or eliminate the introduction of work-piece dimensional errors created by shortcomings in the overall system design.

In one implementation, the work piece 524 is a slider chunk with a lapping surface on the bottom surface. The pressure-adjusting lapping element 532 is specifically configured to provide a desired pressure profile against a lapping plate (not shown) during lapping operations to achieve a desired quantity of material removal and a planar lapping surface. The pressure profile is varied via the actuator nodes and feedback from the electronic lapping guides pressure is used to achieve the desired quantity of material removal and the planar lapping surface, regardless of the thickness of the slider chunk (i.e., how many slider bars remain on the slider chunk 1268) or any overall downward pressure applied against the lapping plate.

In various implementations, the flexible region 578 of the pressure-adjusting lapping element 532 enables more uniform reaction force and pressure characteristics in response to overall lapping forces than prior-art designs. As a result, the application of an overall lapping force to the pressure-adjusting lapping element 532 does not contribute to any dimensional errors in the work-piece 524. Conceptually, the flexible region 578 is a complex spring arrangement with a stiffness along a length of the work piece 524 precisely tailored to create a substantially uniform spring constant along the length of the work piece 524. Therefore, given an outwardly applied, overall down-force upon the lapping plate, the responsive pressure distribution on the work-piece 524 lapping surface is substantially uniform or has a desired pressure response profile.

Prior-art designs fail to recognize the positive effect of this uniform spring rate/uniform pressure distribution/uniform deflection characteristic on work piece 524 lapping operations. As a result, in prior-art designs, the work-piece 524 lapping surface would experience an inconsistent responsive pressure profile, and thus uneven lapping rates across the work piece 524 lapping surface under the overall lapping force. This inconsistent responsive pressure profile of prior art designs may be corrected by providing and manipulating the actuator nodes of the pressure-adjusting lapping element 532.

Figure 6:
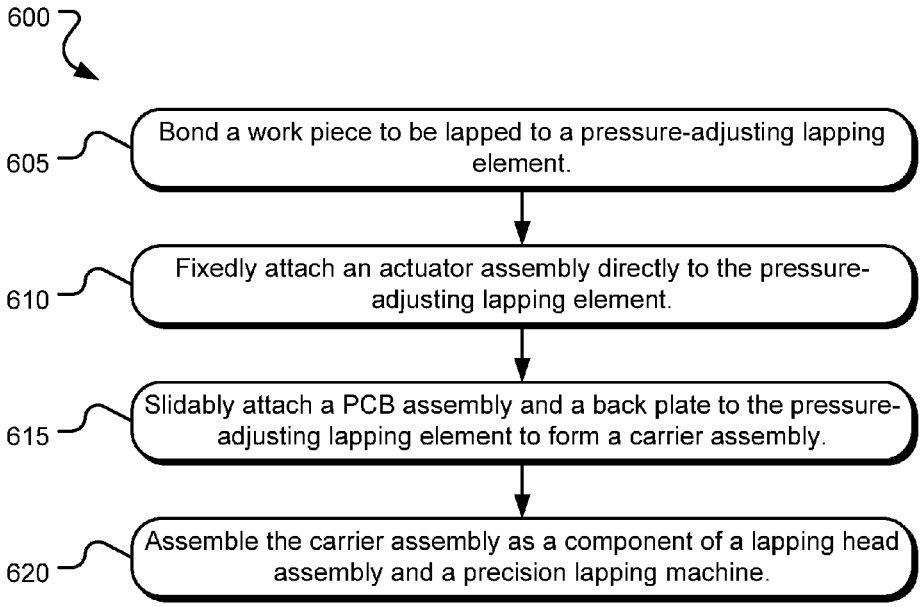
FIG. 6 illustrates example operations for assembling a lapping head assembly incorporating a pressure-adjusting lapping element.

FIG. 6 illustrates example operations 600 for assembling a lapping head assembly incorporating a pressure-adjusting lapping element. A bonding operation 605 bonds a work piece to be lapped to a pressure-adjusting lapping element. In implementations where the work piece is a wafer chunk, the bonding operation occurs once per wafer chunk at the beginning of wafer chunk processing operations.

A first attaching operation 610 fixedly attaches an actuator assembly directly to the pressure-adjusting lapping element. In various implementations, the actuator assembly and the lapping element include matching male/female alignment devices that secure the actuator assembly to the lapping element when pressed together. Further, when pressed together, individual linear actuators on the actuator assembly each engage an actuator node on the lapping element.

A second attaching operation 615 slidably attaches a printed circuit board (PCB) assembly and a back plate to the pressure-adjusting lapping element to form a carrier assembly. In various implementations, the PCB assembly and the back plate are oriented on opposing sides of the lapping element and the lapping element includes two or more slots. Fasteners extend from the PCB assembly, through the slots in the lapping element, and secure within holes in the back plate. As a result, the PCB assembly and the back plate are fixedly attached to one another, with the lapping element able to move axially with respect to the PCB assembly and the back plate.

An assembling operation 620 assembles the carrier assembly as a component of an overall lapping head assembly and a precision lapping machine. The carrier assembly is compressed within the lapping head assembly, which provide precise pitch, roll, and yaw control to the work piece. The lapping head assembly is attached to one or more rails on the precision lapping machine, which allows the lapping head assembly to oscillate the work piece across a lapping pate assembly of the precision lapping machine during lapping operations.

FIG. 7 illustrated example operations 700 for lapping a work piece using an advanced lapping machine incorporating a pressure-adjusting lapping element. A first force application operation 705 applies a lapping force to the pressure-adjusting lapping element of a lapping head assembly. The lapping force is directed at achieving a desired rate of material removal from a work piece during lapping operations. A second force application operation 707 applies a balance correcting force to the pressure-adjusting lapping element of the lapping head assembly. The balance correcting force corrects for slope and/or linear errors (e.g., least-squares line fit angle correction) along a length of the work piece.

A third force application operation 710 applies a pressure distribution force to the pressure-adjusting lapping element. The lapping element includes two or more actuator nodes that permit fine adjustment of the pressure distribution profile on the work piece on a lapping plate. The pressure adjustment force is applied at one or more of the actuator nodes, at desired magnitude(s) and direction(s) to achieve a desired pressure profile on the lapping plate.

A lapping operation 715 laps a surface of the work piece. More specifically, the work piece is pressed against a rotating lapping plate with a pressure profile resulting from a combination of the first force application operation 705 and the second force application operation 710. The lapping plate abrasively removes material from the work piece at a rate corresponding to the pressure profile of the work piece on the lapping plate. A monitoring operation 720 monitors an array of lapping guides embedded within the work piece. More specifically, the lapping guides are resistive elements, each of which indicates thickness of the work piece in the region of the work piece that is monitored by each lapping guide. In combination, the lapping guides can be used to measure a work piece surface profile.

A decision operation 725 determines if lapping operations are complete. The measured work piece profile is compared against a desired work piece profile. If the measured work piece profile does not match the desired work piece profile within an acceptable tolerance, the operations 705-725 are repeated with modified pressure distribution force defined to modify the measured work piece profile to more closely match the desired work piece profile. Further, if a sufficient quantity of material overall has not been lapped from the work piece, regardless of the work piece profile, operations 705-725 may also be repeated. Until lapping is complete, operations 705-725 may be repeated iteratively. Once lapping is complete, removing operation 735 removes the lapped work piece from the pressure-adjusting lapping element for further processing.

The logical operations making up the embodiments of the invention described herein are referred to variously as operations, steps, objects, or modules. Furthermore, it should be understood that logical operations may be performed in any order, adding and/or omitting operations as desired, unless explicitly claimed otherwise or the claim language inherently necessitates a specific order.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A pressure-adjusting lapping element comprising:

a structural region; and a whippletree region, the whippletree region including:

two or more actuator nodes;

one or more element deflection channels oriented between the actuator nodes and the structural region permitting the whippletree region to deflect in response to an applied force at one or more of the actuator nodes; and one or more node separation channels oriented between the individual actuator nodes and permitting the actuator nodes to deflect independently in response to the applied force at the actuator nodes.

2. The pressure-adjusting lapping element of claim 1, wherein the structural region includes one or more receptacles for aligning an actuator assembly with the pressure-adjusting lapping element and securing the actuator assembly to the pressure-adjusting lapping element in an aligned position.

3. The pressure-adjusting lapping element of claim 1, wherein the structural region includes one or more slots for aligning a printed circuit board assembly with the pressure-adjusting lapping element and permitting the pressure-adjusting lapping element to move axially with respect to the printed circuit board assembly.

4. The pressure-adjusting lapping element of claim 1, wherein the structural region is thicker than the whippletree region.

5. The pressure-adjusting lapping element of claim 1, wherein a majority of the node separation channels extend in a direction substantially parallel to a lapping force applied to the pressure-adjusting lapping element and a majority of the element deflection channels extend in a direction substantially perpendicular to the lapping force.

6. The pressure-adjusting lapping element of claim 1, further comprising:

a work piece attached to the whippletree region of the pressure-adjusting lapping element.

7. The pressure-adjusting lapping element of claim 6, wherein the work piece is a slider chunk.

8. A method comprising:

applying a lapping force to a structural region of a pressure-adjusting lapping element;

applying a pressure distribution force at one or more actuator nodes of a flexible region of the pressure-adjusting lapping element, wherein the flexible region includes:

one or more element deflection channels oriented between the actuator nodes and the structural region permitting the flexible region to deflect in response to the pressure distribution force; and one or more node separation channels oriented between the individual actuator nodes and permitting the actuator nodes to deflect independently in response to the pressure distribution force; and lapping a work piece attached to the flexible region of the pressure-adjusting lapping element.

9. The method of claim 8, wherein a reaction force on a lapping surface of the work piece is substantially uniform.

10. The method of claim 8, further comprising:

measuring a lapping surface profile of the work piece; and varying the applied pressure distribution force to achieve a desired lapping surface profile of the work piece.

11. The method of claim 9, iteratively performing the measuring and varying operations to maintain the desired lapping surface profile as the work piece is lapped.

12. The method of claim 9, wherein the measuring operation is achieved by measuring resistance at each of an array of electronic lapping guides embedded within the work piece.

13. The method of claim 9, wherein the desired lapping surface profile is planar.

14. The method of claim 8, wherein the flexible region includes a whippletree structure.

15. A carrier assembly comprising:

a pressure-adjusting lapping element including:

two or more actuator nodes;

one or more element deflection channels oriented between the actuator nodes and the structural region permitting the flexible region to deflect in response to an applied force at one or more of the actuator nodes; and one or more node separation channels oriented between the individual actuator nodes and permitting the actuator nodes to deflect independently in response to the applied force at the actuator nodes; and an actuator assembly directly attached to the pressure-adjusting lapping element, the actuator assembly including two or more linear actuators, each of which engages one of the actuator nodes and provides the applied force at the one or more actuator nodes.

16. The carrier assembly of claim 15, further comprising:

a u-shaped back support slidably attached to the pressure-adjusting lapping element and permitting the pressure-adjusting lapping element to move axially with respect to the u-shaped back support.

17. The carrier assembly of claim 15, further comprising:

a printed circuit board assembly fixedly attached to the u-shaped back support and slidably attached to the pressure-adjusting lapping element.

18. The carrier assembly of claim 15, further comprising:

a work piece attached to the pressure-adjusting lapping element.

19. The carrier assembly of claim 15, wherein the pressure-adjusting lapping element includes a structural region and a flexible region, wherein the flexible region includes the actuator nodes, the element deflection channels, and the node separation channels.

20. The carrier assembly of claim 19, wherein the structural region is thicker than the flexible region.

* * * * *